US006164337A

United States Patent [19]

Weise et al.

[11] Patent Number: 6,164,337

[45] Date of Patent: Dec. 26, 2000

[54] PLUMBING APPARATUS

[76] Inventors: Gary K. Weise, #8 Haggerston Aisle, Irvine, Calif. 92715; Richard Kesl, 3560 Vista Glen Cir., Yorba Linda, Calif. 92886

[21] Appl. No.: 09/382,053

[22] Filed: Aug. 24, 1999

Related U.S. Application Data

[63] Continuation-in-part of application No. 08/948,126, Oct. 9, 1997, Pat. No. 5,992,466.

[51] Int. Cl.[7] ..... F15D 1/08

[52] U.S. Cl. ..... 138/44; 138/120; 285/21.3; 285/148.23; 285/331; 285/423; 285/179

[58] Field of Search ..... 285/331, 148.23, 285/FOR 159, 423, FOR 132, 21.3, 179; 138/44, 120

[56] References Cited

U.S. PATENT DOCUMENTS

| | | | |
|---|---|---|---|
| 2,415,992 | 2/1947 | Clair | 138/40 |
| 2,676,470 | 4/1954 | Streitz | 138/44 |
| 2,680,715 | 6/1954 | Cook | 138/40 |
| 2,958,334 | 11/1960 | Curtis | 138/40 |
| 3,463,691 | 8/1969 | Martin | 138/149 |
| 3,890,656 | 6/1975 | Mathis | 138/40 |
| 3,946,449 | 3/1976 | Mathis | 138/40 |
| 4,105,721 | 8/1978 | Schiebe | 138/44 |
| 4,256,333 | 3/1981 | Jones | 285/331 |
| 4,271,099 | 6/1981 | Kukla | 138/40 |
| 4,313,286 | 2/1982 | Harbeke | 285/331 |
| 4,712,812 | 12/1987 | Weir | 138/96 T |
| 4,860,796 | 8/1989 | Hagin | 138/90 |
| 5,992,466 | 11/1999 | Weise | 138/44 |

FOREIGN PATENT DOCUMENTS

| | | | |
|---|---|---|---|
| 3131336 | 2/1983 | Germany | 285/FOR 132 |

*Primary Examiner*—Dave W. Arola
*Attorney, Agent, or Firm*—Terry L. Miller

[57] ABSTRACT

A bubble jet fitting for use in a pool or spa provides for a lay-length short enough to allow its installation within a six-inch dam wall. The bubble jet fitting has an outlet portion which in one use provides for solvent welding therein of either one of two different standard sizes of PVC pipe. An axially extending annular recess of the fitting may receive a surfacing layer of plaster or fiberglass to form a water-tight interface with the surrounding wall of the pool or spa.

9 Claims, 4 Drawing Sheets

PLUMBING APPARATUS

CROSS REFERENCE TO RELATED APPLICATION

This application is a Continuation-in-Part of U.S. patent application Ser. No. 08,948,126, filed Oct. 9, 1997, now U.S. Pat. No. 5,992,466, issued Nov. 30, 1999.

BACKGROUND OF THE INVENTION

1. Field of the Invention

The present invention is in the field of plumbing apparatus. Particularly, the invention relates to plumbing apparatus designed and made for use with water. Still more particularly, the present invention relates to plumbing fittings configured for solvent bonding with plastic piping to form a water delivery or circulation system. The plumbing apparatus is particularly suited to use in connection with a water delivery or circulation system of a swimming pool, hot tub, or spa, for example. One embodiment of the present invention provides a plumbing fitting have an advantageously short assembled length with other fittings and pipe.

2. Related Technology

It is conventional in spas and hot tubs to have a pump which draws water from the spa, circulates this water through a heater, and delivers the heated water back to the spa. Particularly at the point or points of introduction of the heated water back into the spa, it is conventional to provide one or more water-powered aspirators. An aspirator of this type is commonly referred to as an "air jet" or a "bubble jet", or as a "venturi-T", or just as a "jet", and functions to ingest ambient air. The heated water and air are introduced together into the spa in order to make the spa bubbly. Commonly, the "jet" of bubbly water is introduced into the spa via a pipe stub ending flush with a side wall of the spa. Alternatively, the "jet" is introduced into the spa water via an "eye ball" fitting set into the side wall of the spa. Such "eye ball" fittings allow the jet of water and air to be adjusted to best suit the wishes of the users of the spa, dependent upon the number of people using the spa and the seating locations within the spa water, for example. Generally, pools and spas constructed using GUNNITE™, or SHOTCRETEM™, (which are concrete spraying processes) do not use an "eyeball" fitting at the bubble jet fittings.

In spas which share a water supply with and are adjacent to a pool, it is conventional to have a wall between and common to both the pool and the spa. Such a common shared wall is generally referred to as a "dam wall." The dam wall of a pool/spa is generally only about six inches thick in order to utilize the generally available size of decorative tile. In such cases, the generally available plumbing fittings make it very difficult or impossible to install bubble jets in the dam wall. In order to allow the installation of bubble jets in the dam wall, some pool/spa installations undesirably utilize a dam wall that is thicker than six inches. In such cases, the dam wall may be as thick as nine inches or even twelve inches. Such a thick dam wall necessitates an increase in the materials used to construct the pool/spa, and increases the costs of materials and construction.

Further, it is conventional when installing a bubble jet fitting in the wall of a pool or spa to use a short length of pipe to convey the bubbling jet of water into the pool or spa. Conventional bubble jet fittings generally allow only a single diameter of pipe to be used for this purpose.

Also, when installing a conventional bubble jet fitting into a wall of a pool or spa, a concern has been the achieving of a water-tight interface between the fitting and the concrete and/or plaster of the pool. Generally, the fitting is disposed in the concrete of a pool wall with the plaster of the pool being relied upon to prevent water seepage along the interface between the fitting and the concrete. Unfortunately, this water-tight interface is not always achieved reliably.

SUMMARY OF THE INVENTION

In view of the above, it is desirable and is an object of this invention to provide a bubble jet fitting which is especially configured to allow its use within a six-inch dam wall.

Further, it is an object of this invention to provide such a bubble jet fitting which in a single size of fitting will interface with two different sizes of outlet piping by solvent welding.

Still further, it is an object for this invention to provide a bubble jet fitting which has a water inlet portion and an air inlet portion, each of which is configured to interface with piping of one size and with a plumbing fitting of another size, both by solvent welding.

Additionally, it is an object for this invention to provide such a bubble jet fitting which provides a more reliable structure for achieving a water-tight interface between the fitting and the concrete and plaster wall of a pool or spa, for example.

Accordingly, the present invention in one embodiment provides bubble jet fitting for solvent welding with standard PVC pipe and fittings; the bubble jet fitting comprising: a body formed of plastic which may be solvent welded with PVC pipe and fittings; the body defining a water inlet portion having a pipe socket in water flow communication with a water chamber, and air inlet portion defining a respective pipe socket in water flow communication with an air chamber, a nozzle extending from the water chamber to direct a jet of water across the air chamber and toward an outlet, and an outlet portion aligning with the nozzle and defining the outlet, the outlet portion including a pair of coaxially arranged annular walls each of which forms a respective one of a pair of coaxial pipe sockets of differing size about the outlet, whereby a jet of water issuing from the nozzle entrains air from the air chamber and delivers this air and water together to the outlet portion to flow outwardly of the fitting.

Another embodiment of the present invention presents a method of providing a water-tight interface between construction materials of a pool or spa and a bubble jet fitting embedded in these construction materials, the method comprising steps of: providing the bubble jet fitting with an outlet portion of generally cylindrical shape extending to open through a surfacing layer of construction material of the pool or spa; configuring the outlet portion to outwardly define a radially outer cylindrical annular wall portion inwardly defining a cylindrical socket surface sized to snugly receive therein and to solvent weld therein an end portion of a horizontally extending PVC pipe of a larger size; providing the outlet portion to further inwardly define another radially inner cylindrical annular wall portion inwardly defining a cylindrical socket surface sized to snugly receive therein and to solvent weld therein an end portion of a horizontally extending PVC pipe of a smaller size; utilizing the radially outer cylindrical annular wall portion and the radially inner cylindrical annular wall portion cooperating to define an axially extending horizontal recess therebetween into which the PVC pipe of larger size may be received; and providing for the axially extending horizontal recess to alternatively receive therein an annular portion of the surfacing layer of construction material at the pool or spa thereby forming a watertight seal.

An advantage of the present invention derives from its provision of plumbing fittings which are especially configured to be solvent welded to standard PVC plastic pipe. That is, according to one use of the plumbing fittings provided by the present invention, a fitting embodying the invention is joined to a plastic pipe by having a spigot of the fitting slipped into and solvent welded to an end of a plastic pipe. Another advantage of the bubble jet fitting provided by the present invention is that it can connect to either one of the two most commonly used sizes of outlet piping for use in a spa. In other words, the bubble jet fitting can connect to a 1 inch pipe by providing a socket into which the end of this size of pipe is received and solvent welded. On the other hand, the outlet portion of the bubble jet fitting also provides coaxially with the 1 inch socket an outer 1½ inch socket into which an end portion of a pipe of that size will fit to be solvent welded. The end portion of the 1½ inch pipe fits over the 1 inch socket and within the outer 1½ socket.

A better understanding of the present invention will be obtained from reading the following description of two preferred exemplary embodiments of the present invention when taken in conjunction with the appended drawing Figures, in which the same features (or features which are analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a fragmentary perspective view, partially in cross section, of a bubble jet fitting embodying the present invention installed in a dam wall of a swimming pool/spa;

FIG. 2 provides a cross sectional view of the bubble jet fitting seen in FIG. 1, and is presented in a larger size for better illustration on of features of the fitting;

FIG. 3 provides a perspective view of the bubble jet fitting seen in FIGS. 1 and 2;

FIGS. 4–7 provide orthographic views of the bubble jet fitting seen in FIGS. 1–3, and FIG. 8 provides a cross sectional view similar to FIG. 1, but showing an alternative embodiment of a bubble jet fitting according to the present invention.

DETAILED DESCRIPTION OF EXEMPLARY PREFERRED EMBODIMENTS OF THE INVENTION

Figure 1:
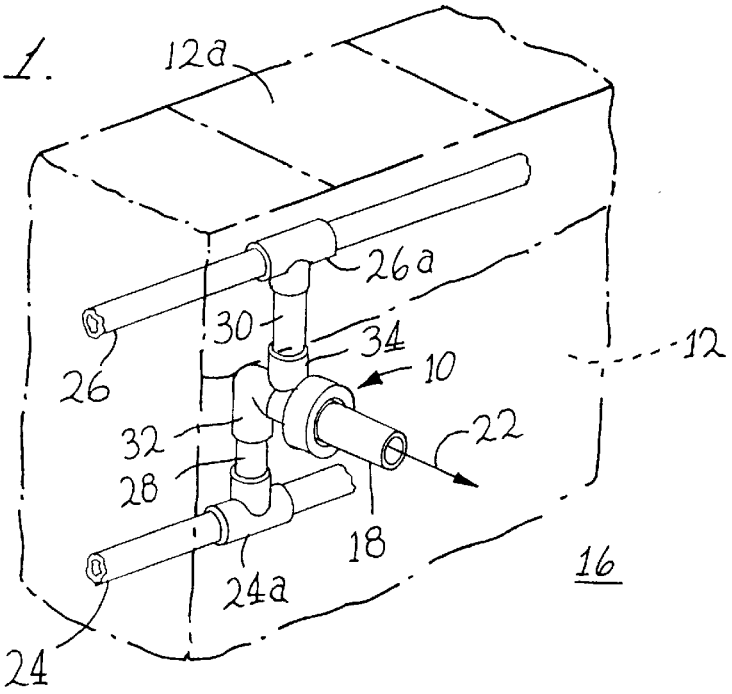

Viewing FIG. 1, a bubble jet fitting 10 is seen installed within a dam wall 12. This bubble jet fitting has a body 10*a*, which is preferably formed of plastic to allow it to be solvent welded to standard plumbing fittings and pipe, as will be further explained. Preferably, the dam wall 12 is only about 6 inches thick. This thickness for the dam wall 12 provides for use on the top surface 12*a* of this wall of standard six-inch decorative tile, which are indicated in phantom lines on FIG. 1 and with the numeral 12*b*. The dam wall 12 forms a boundary between a pool 14 on the far side of this wall 12 as seen in FIG. 1, and a spa 16 on the near side of this wall 12 as seen in FIG. 1. Accordingly, it is seen that the fitting 10 is connected with a pipe stub 18 opening into the spa 16 below the level 20 of the water in this spa. As is indicated by the arrow 22 on FIG. 1, when the bubble jet 10 is operating it discharges a jet of aerated water into the water 20 of the spa 16, and thus makes this spa water bubbly.

Also seen in FIG. 1 is a plastic water pipe 24 and a plastic air pipe 26, each having a respective "T" fitting (24*a* and 26*a*, respectively) interposed therein by solvent welding. The "T" fittings 24*a* and 26*a* allow for connection with the fitting 10. That is, from each "T" fitting 24*a* and 26*a*, a respective short length of plastic pipe 28 and 30 extends vertically each respectively to be solvent welded into a respective water inlet portion 32 and into an air inlet portion 34 of the bubble jet fitting 10. The pipes 24 and 26 generally circumscribe the spa 16 in order to respectively provide both pressurized water (which is usually heated to warm the spa) and ambient air to multiple bubble jet fittings (not shown on FIG. 1) at several locations of the side walls of the spa 16. Because it is generally desirable to locate these bubble jets at differing elevations around the spa 16, the spacing between pipes 24 and 26 will be large enough that the elevations of the jets 22 of bubbly water can be varied by using differing lengths for the pipes 28 and 30. In other words, the pipes 24 and 26 will be further apart vertically than appears to be the case in FIG. 1, which Figure is not to scale.

Figure 2:
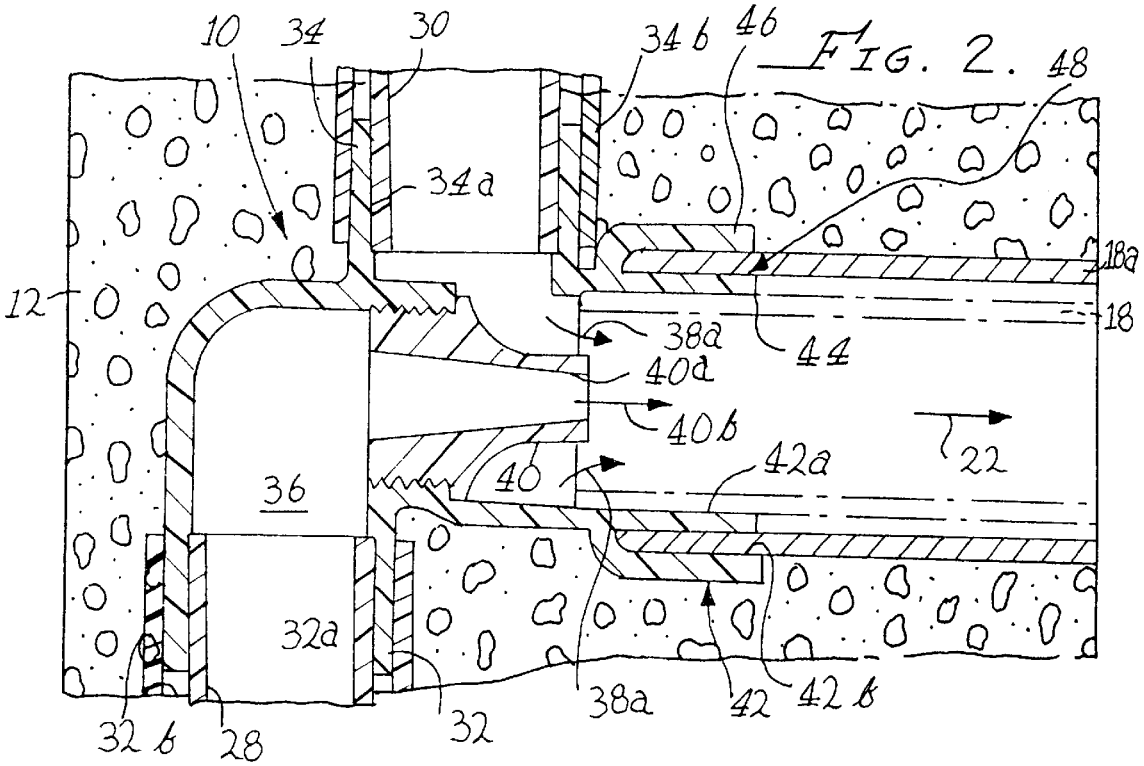
Figure 3:
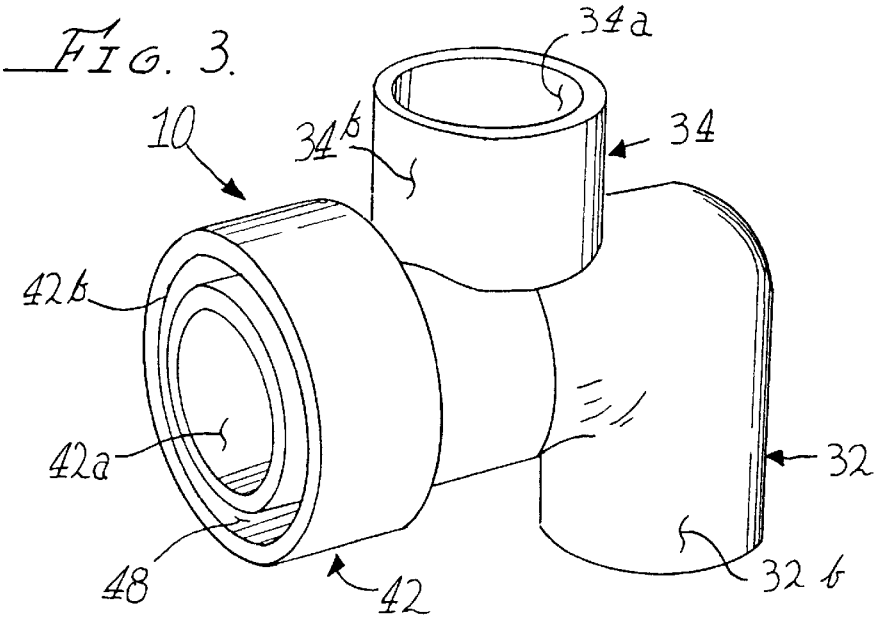
Figure 4:
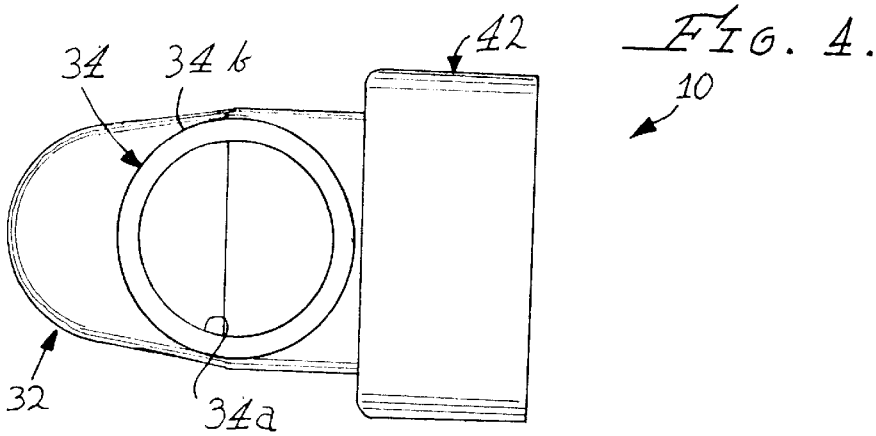
Figure 5:
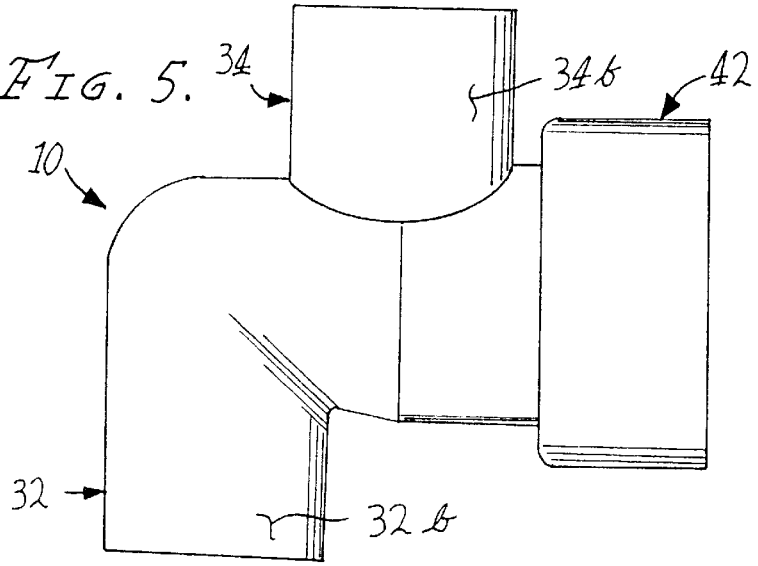
Figure 6:
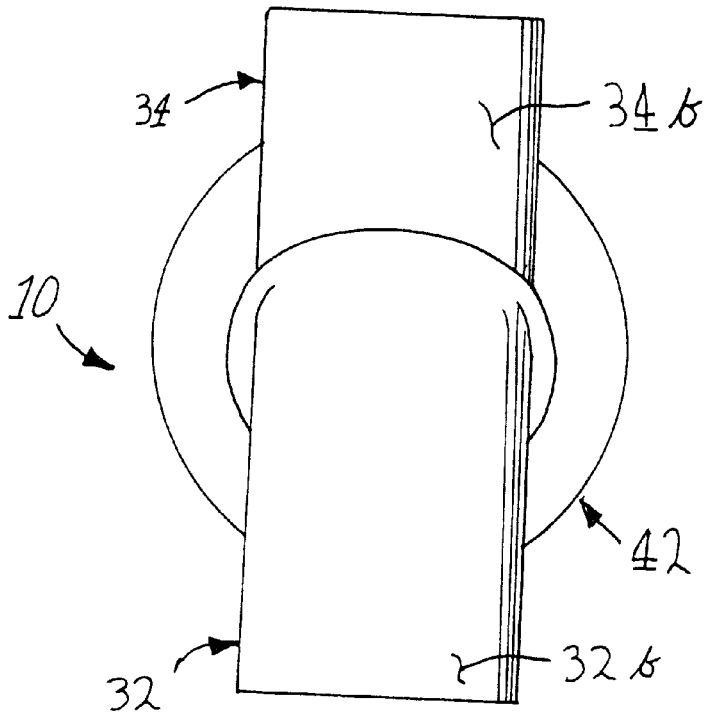
Figure 7:
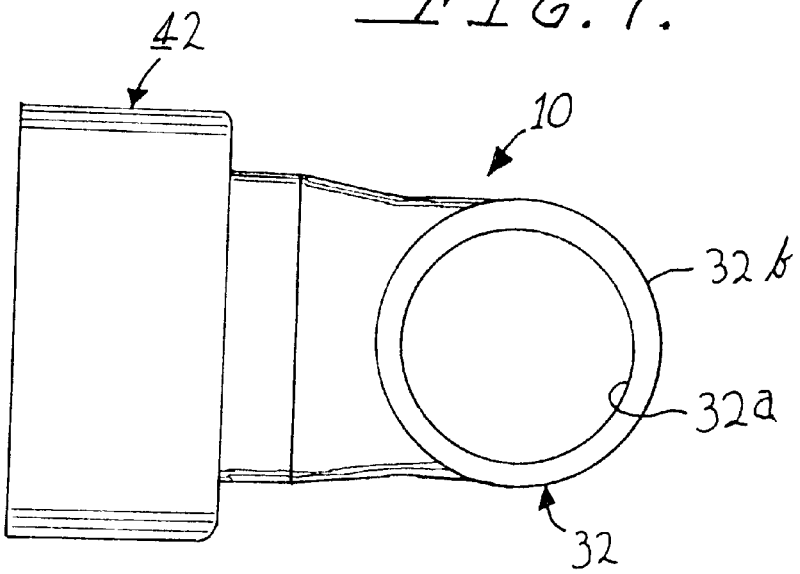

Viewing now FIG. 2, it is seen that both the water inlet portion 32 and the air inlet portion 34 are configured as dual-function spigot/sockets. In other words, each of these portions inwardly defines a respective socket 32*a* and 34*a*, into which an end portion of the pipes 28 and 30 may be solvent welded as seen in FIG. 2. Also, each of these portions 32 and 34 outwardly defines a generally cylindrical spigot surface 32*b* and 34*b*, which may be received into a socket of a pipe fitting such as a "T" fitting (indicated with dashed lines on FIG. 2) to be solvent welded. The pipe fittings into which the spigot surfaces 32*b* and 34*b* can be solvent welded will be of larger size than the a "T" fittings 24*a* and 26*a* at the location receiving the spigot portions 32*b* and 34*b*. For example, if the pipes 24, 26, 28, and 30 are ¾ inch plastic pipe, then the spigot surfaces 32*b* and 34*b* will be sized to be received into a socket of a standard 1 inch plastic pipe fitting. This dual-function structure for the portions 32 and 34 allows the bubble jet fitting 10 to be installed by plumbers using a wide variety of different pipe and fitting combinations in different sizes. Preferably, the portions 32 and 34 are sized to receive and connect with ¾ inch pipe, and to spigot into one-inch fittings.

Still viewing FIG. 2, it is seen that the water inlet portion 32 connects pressurized water from pipe 28 into a water inlet chamber 36, while air inlet portion 34 connects pipe 30 with an air inlet chamber 38. As is seen on FIG. 2, the water inlet portion 32 in essence defines a 90° elbow, and turns the water flow entering from pipe 28 from a vertical flow direction to a horizontal flow direction. From the water inlet chamber 36, a nozzle 40 extends horizontally into chamber 38, and defines an opening 40*a* directing a horizontal jet of water 40*b* across the chamber 38. That is, the bubble jet fitting 10 accepts a vertical flow of water from pipe 28, turns this flow 90° to flow horizontally, and forms a horizontally extending jet 40*b* projecting across air chamber 38. The jet 40*b* of pressurized water projecting across chamber 38 ingests ambient air from this chamber (as is indicated by arrows 38*a* on FIG. 2), and entrains this air in the flow 22 of aerated water flowing to the spa 16.

In order to conduct the flow of bubbly water 22 to the spa 16, the fitting 10 includes an outlet portion 42 aligned with the jet 40*b* and receiving the flow 22. This outlet portion internally defines a socket 42*a* which is sized to receive an end portion of the pipe stub 18 (this pipe stub is illustrated in FIG. 2 with dashed lines for a reason that will be clear in view of the explanation below). This pipe stub will be solvent welded in socket 42*a*. Alternatively, the bubble jet fitting 10 may also connect at portion 42 to a pipe 18*a* of larger size than pipe 18. In other words, the fitting 10 at portion 42 defines a coaxially arranged outer socket 42*b* of larger size than socket 42*a*, and which is sized to receive and be solvent welded to a pipe 18*a* of larger size than pipe 18. For example, if pipe 18 is of one-inch size, then the outer socket 42*b* will be sized to receive and solvent weld to 1½ inch plastic pipe. Thus, a user of the fitting 10 is provided with another pair of options for use of different sizes of pipe for installing the bubble jet fitting 10.

More particularly, it will be seen that the outlet portion 42 includes an inner annular wall 44, which defines the substantially cylindrical socket surface 42*a*. Similarly, the outlet portion 42 includes an outer annular wall 46, which defines the substantially cylindrical socket surface 42*b*. Between the walls 44 and 46, these walls cooperatively define a dual function axially extending annular recess 48. A first function for this recess is illustrated in FIG. 2, where the pipe 18*a* is shown being received into this recess. It will be understood that the outside diameter of the wall 44 (defining inwardly the socket 42*a*) is sufficiently small in diameter that ordinary variations in wall thickness of pipe 18*a* is accommodated without the pipe interfering at its somewhat variable inside diameter with the wall 44. Further, another function of the dual-function annular recess is to facilitate a water-tight interface between the fitting 10, and the wall 12 of the pool or spa, as will be explained.

Figure 8:
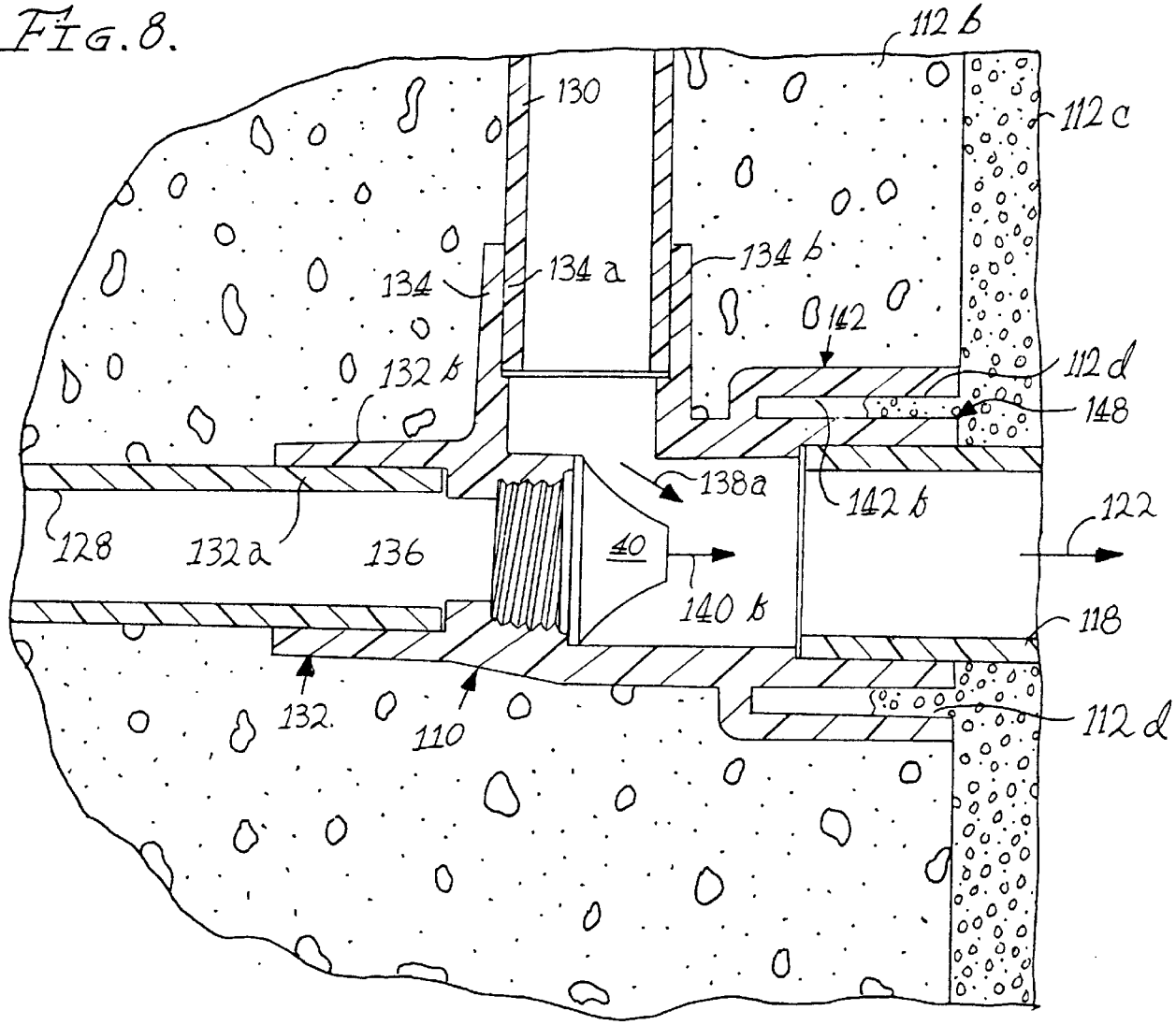

More particularly, turning now to consideration of FIG. 8, an alternative embodiment of the bubble jet fitting is illustrated. This fitting is also installed in a pool or spa wall. In order to obtain reference numerals for use in describing this alternative embodiment of the present inventive swimming pool fitting, features of FIG. 8 which are the same as or which are equivalent in structure or function to features depicted and described above, are indicated on FIG. 8 with the same numeral used above, and increased by one-hundred (100).

Viewing FIG. 8, it is seen that a bubble jet fitting 110 is installed within a wall 112. The wall 112 includes a concrete aggregate 112*b* (such as GUNNITE™, or SHOTCRETE™, for example), and a surfacing layer 112*c* of plaster or fiberglass. Conventionally, the plaster surfacing layer 112*c* is trawled onto the concrete 112*b* of a pool or spa, while a fiberglass surfacing finish layer will be applied with a chopper spray gun. In each case. The concrete 112*b* is formed first, after completion of the plumbing that includes bubble jet fitting 110. It will be noted in FIG. 8 that the fitting 110 is of a straight configuration, so that the water inlet portion 132 aligns with the direction of the jet 140, and also with the direction of discharge of bubbly water 122.

Further, during installation of the bubble jet fitting, a pipe stub 118 (having a length at the time which is greater than that seen in FIG. 8) is installed in the fitting before the concrete 112*b* is placed. At this time, a sacrificial outer pipe stub (not seen in FIG. 8) of about the same length as stub 118, is inserted temporarily (i.e., not solvent welded) into the socket 142*b* (that is, into recess 148). Subsequently, when the concrete 112*b* is placed (i.e., by "shooting" this concrete in a process which is essentially spraying), this concrete is "shot" into place so that its surface is at the level relative to the fitting 110, as is generally seen in FIG. 8. That is, the concrete 112*b* is placed so that its surface is essentially flush with the discharge portion 142 of the fitting 110. Next, before the concrete 112*b* cures completely, the outer sacrificial pipe stub is removed from recess 148. This leaves the recess 148 open and free of concrete.

Next, the surfacing plaster or fiberglass 112*c* is placed, and during placement extends at least partially into the recess 148, as is indicated by arrowed numeral 112*d* of FIG. 8). After the surfacing layer of plaster or fiberglass 112*c* is cured, the pipe stub 118 is trimmed to be flush with the surface of the surfacing layer 112*c*, as is seen in FIG. 8. The result is that the surfacing layer 112*c* at least partially enters and locks into the recess 148. Consequently, this interlocking of the surfacing layer 112*c* with the fitting 110 substantially prevents seepage of water from the pool or spa along the interface of the wall 112 with the fitting 110.

Now that the two alternative installations of FIGS. 2 and 8 have been considered, an additional alternative may be considered. Considering FIG. 2, for example, if the fitting 10 is installed using the larger 1½ inch pipe 18*a* at the outlet of the fitting, and depending upon the depth of water above the fitting and the available water pressure and flow rate at the inlet 36, in the event that difficulty is encountered in getting the jet to aerate, then an additional smaller diameter piece of pipe (as is indicated in dashed lines with numeral 18) may be inserted into the fitting. This additional piece of pipe 18 may be simply forced into the socket 42*a*, or may be solvent welded into place. The advantage of using this additional piece of pipe 18 in the fitting 10 is that with deeply submerged fittings having low water pressure or low flow, they may not aerate as well as desired. By making the discharge conduit smaller (i.e., by the use of the smaller pipe 18, as seen in FIG. 2) the aeration effect of the jet will be improved.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. For example, the bubble 10 fitting seen in FIGS. 1–7 is not limited to installation having the water inlet at the bottom and air inlet from above. This fitting can be installed with the water and air inlets extending horizontally (i.e., entering from the sides of the fitting). Accordingly, the depicted and described preferred embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A bubble jet fitting for solvent welding with standard PVC pipe and fittings; said bubble jet fitting comprising: a body formed of plastic which may be solvent welded with PVC pipe and fittings; said body defining a water inlet portion having a pipe socket in water flow communication with a water chamber, an air inlet portion defining a respective pipe socket in air flow communication with an air chamber, a nozzle extending from said water chamber to direct a jet of water across said air chamber and toward an outlet, and an outlet portion aligning with said nozzle and defining said outlet, said outlet portion including a pair of coaxially arranged annular walls each of which forms a respective one of a pair of coaxial pipe sockets of differing size about said outlet, whereby a jet of water issuing from said nozzle entrains air from said air chamber and delivers this air and water together to said outlet portion to flow outwardly of said fitting.

2. The bubble jet fitting of claim 1 in which a radially inner one of said pair of coaxially arranged annular walls outwardly defines a cylindrical surface portion sized to slip substantially without interference into a PVC pipe, which PVC pipe is solvent welded within the radially outer one of said pair of coaxially arranged pipe sockets.

3. The bubble jet fitting of claim 1 in which at least one of said water inlet portion and said air inlet portion inwardly defines a socket sized and configured to accept therein and to solvent weld to an end portion of a PVC pipe, and said at least one inlet portion also defines outwardly a surface portion sized and configured to be accepted within and solvent weld into a socket of a PVC pipe fitting.

4. A bubble jet fitting for solvent welding with standard PVC pipe and fittings; said bubble jet fitting comprising:

a body formed of plastic which may be solvent welded with PVC pipe and fittings; said body defining a water inlet portion in water flow communication with a water chamber, an air inlet portion in air flow communication with an air chamber, a nozzle directing a jet of water across said air chamber and toward an outlet, and a tubular outlet portion aligning with said nozzle to accept said jet of water and defining said outlet;

said tubular outlet portion outwardly defining an outer cylindrical annular wall portion defining an outer pipe socket sized to receive and to solvent weld to an end portion of a PVC pipe of a larger size, and further defining inwardly an inner cylindrical annular wall portion defining an inner pipe socket sized and configured to accept therein and to solvent weld to an end portion of a PVC pipe of a smaller size;

said water inlet portion inwardly defining a socket sized and configured to accept therein and to solvent weld to an end portion of a PVC pipe, and also defining outwardly a surface portion sized and configured to be accepted within and to solvent weld into a socket of a PVC pipe fitting;

said air inlet portion also inwardly defining a socket sized and configured to accept therein and to solvent weld to an end portion of a PVC pipe, and defining outwardly a surface portion sized and configured to be accepted within and to solvent weld into a socket of a PVC pipe fitting;

whereby a jet of water issuing from said nozzle entrains air from said air chamber and delivers the air and water together outwardly of said fitting via said outlet.

5. A bubble jet fitting for solvent welding in a position spaced vertically between a pair of opposed vertically-extending standard PVC pipes, in which one of said pair of pipes flows a supply of pressurized water toward and into said fitting and the other of said pair of pipes flows a supply of ambient air toward and into said bubble jet fitting, said fitting comprising:

a body defining a water inlet portion with a pipe socket in water flow communication with a water chamber, an air inlet portion defining a respective pipe socket in air flow communication with an air chamber, a nozzle extending from said water chamber substantially horizontally to direct a jet of water across said air chamber and toward an outlet, and an outlet portion aligning with said nozzle and defining said outlet, and wherein said body further defines at said outlet portion a pair of coaxially arranged pipe sockets portions each of which inwardly defines a socket surface sized and configured to accept therein and to solvent weld to an end portion of a standard PVC pipe respectively of a first size, and of a second size which is larger than said first size.

6. The bubble jet fitting of claim 5 wherein at least one of said water inlet portion and said air inlet portion outwardly defines an elongate cylindrical surface sized to be received into and be solvent welded to a pipe socket portion of a standard PVC pipe fitting.

7. The bubble jet fitting of claim 5 wherein said outlet portion is generally cylindrical and substantially horizontally extending to outwardly define a radially outer cylindrical annular wall portion inwardly defining a cylindrical socket surface sized to snugly receive therein and to solvent weld therein an end portion of a horizontally extending PVC pipe of a larger size, and said outlet portion further inwardly defining another radially inner cylindrical annular wall portion inwardly defining a cylindrical socket surface sized to snugly receive therein and to solvent weld therein an end portion of a horizontally extending PVC pipe of a smaller size, and said radially outer cylindrical annular wall portion and said radially inner cylindrical annular wall portion cooperating to define an axially extending horizontal recess therebetween into which said PVC pipe of larger size may be received, whereby said axially extending horizontal recess may also receive a portion of a surfacing layer of construction material at a pool or spa to form a water-tight interface with said surfacing layer.

8. The bubble jet fitting of claim 5 wherein both of said water inlet portion and said air inlet portion each outwardly defines a respective cylindrical surface, said respective cylindrical surfaces of both said water inlet portion and of said air inlet portion being sized to be received into and to be solvent welded to a respective pipe socket portion of a standard PVC pipe fitting.

9. A method of providing a water-tight interface between construction materials of a pool or spa and a bubble jet fitting embedded in these construction materials, said method comprising steps of:

providing said bubble jet fitting with an outlet portion of generally cylindrical shape extending to open through a surfacing layer of construction material of the pool or spa;

configuring said outlet portion to outwardly define a radially outer cylindrical annular wall portion inwardly defining a cylindrical socket surface sized to snugly receive therein and to solvent weld therein an end portion of a horizontally extending PVC pipe of a larger size;

providing said outlet portion to further inwardly define another radially inner cylindrical annular wall portion inwardly defining a cylindrical socket surface sized to snugly receive therein and to solvent weld therein an end portion of a horizontally extending PVC pipe of a smaller size;

utilizing said radially outer cylindrical annular wall portion and said radially inner cylindrical annular wall portion cooperating to define an axially extending horizontal recess therebetween into which said PVC pipe of larger size may be received; and providing for said axially extending horizontal recess to alternatively receive therein an annular portion of the surfacing layer of construction material at the pool or spa thereby form a water-tight interface with said surfacing layer.

* * * * *